US005456195A

United States Patent [19]

Ozaku et al.

[11] Patent Number: 5,456,195

[45] Date of Patent: Oct. 10, 1995

[54] OPENER FOR HORIZONTAL ROTARY SHUTTLE

[75] Inventors: Minoru Ozaku; Toshiaki Takahara, both of Chofu, Japan

[73] Assignee: Juki Corporation, Chofu, Japan

[21] Appl. No.: 339,651

[22] Filed: Nov. 15, 1994

Related U.S. Application Data

[63] Continuation of Ser. No. 44,410, Apr. 8, 1993, abandoned.

[30] Foreign Application Priority Data

Apr. 8, 1992 [JP] Japan ..... 4-115341

[51] Int. Cl.[6] ..... D05B 57/14

[52] U.S. Cl. ..... 112/184; 112/228

[58] Field of Search ..... 112/181, 182, 112/189, 190, 228, 184, 191

[56] References Cited

U.S. PATENT DOCUMENTS

| | | | |
|---|---|---|---|
| 2,138,939 | 12/1938 | Pudelko | 112/228 |
| 2,990,794 | 7/1961 | Ketterer | 112/228 |
| 4,142,475 | 3/1979 | Zocher | 112/181 |
| 5,189,973 | 3/1993 | Krumme et al. | 112/231 |

FOREIGN PATENT DOCUMENTS

| | | | |
|---|---|---|---|
| 61-154597 | 7/1986 | Japan . | |
| 620075 | 3/1949 | United Kingdom | 112/184 |

*Primary Examiner*—C. D. Crowder
*Assistant Examiner*—Paul C. Lewis
*Attorney, Agent, or Firm*—Morgan & Finnegan

[57] ABSTRACT

A sewing machine having a projection formed on an inner shuttle of a shuttle-inner shuttle assembly to prevent the inner shuttle from being rotated in the same direction in which the shuttle is rotated, thereby providing a gap through which the needle thread passes.

9 Claims, 4 Drawing Sheets

FIG. 6(a)
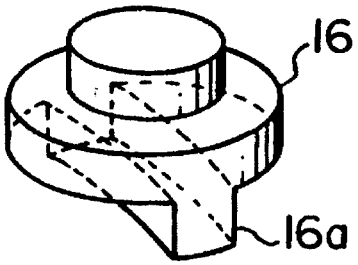
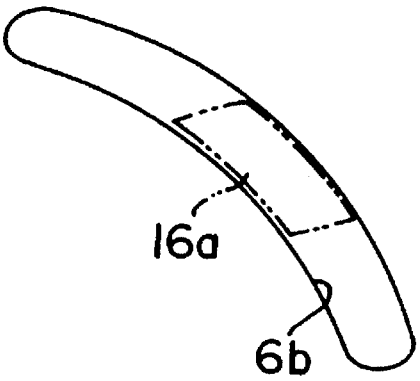
FIG. 6(b)

OPENER FOR HORIZONTAL ROTARY SHUTTLE

CROSS REFERENCE TO RELATED APPLICATION

This application is a continuation of application Ser. No. 08/044,410 filed on Apr. 8, 1993 now abandoned.

BACKGROUND OF THE INVENTION

This invention relates to sewing machines. More particularly, the invention relates to a mechanism for providing a needle thread loop passage between a throat plate and a shuttle-bobbin assembly.

Various types of openers for horizontal rotary shuttles have been heretofore proposed. FIGS. 1 and 2 show a shuttle-bobbin assembly where one type of conventional opener has been incorporated. The structure includes an inner shuttle guide arm 6 having a shank 6*a* at one end thereof and a fulcrum shaft 5 at the other end thereof. An inner shuttle guide 7 is rigidly mounted on the shank 6*a* at its top, a swing lever 10 is pivotally mounted on the inner shuttle guide arm 6 at the other end thereof, and an eccentric cam 9 is eccentrically rotatable about a shuttle shaft 8.

In such a conventional opener, an inner shuttle 2 containing a bobbin thread is likely to tend to be rotated when a shuttle 1 is rotated clockwise. The inner shuttle 2 is, however, prevented from rotation by having two machine frame support segments 3, 4 which are separated by a slot, the machine frame support segments downwardly extending from a throat plate 19 abutted against a projection 2*a* at the opposite sides thereof formed on the inner shuttle 2. In this connection, it is noted that in order to seize the needle thread loop formed by the needle with a point 1*a* of the shuttle 1 to pass through the shuttle for formation of stitches, the needle thread loop is required to pass between the projection 2*a* and the support segments 3, 4. The projection 2*a*, however, abuts against the support segment 3 disposed forwardly of the projection because the inner shuttle 2 is susceptible to clockwise rotation. Thus, when the inner shuttle 2 is clockwise rotated, the needle thread loop is prevented from passing between the projection 2*a* and the support segments 3, 4 unless a gap or clearance is formed therebetween.

An opener is provided for defining the gap or clearance between the projection and the support segments. The opener illustrated in FIGS. 1 and 2 has been well known to the sewing machine art. It has been found that the needle thread loop passes between the projection 2*a* and the support segments 3, 4 to rotate the eccentric cam 9, thereby dislocating the swing lever 10. This rotates the inner shuttle guide arm 6 counterclockwise about the support shaft 5 as seen in FIG. 1. As a result, the inner shuttle guide 7 is driven by the counterclockwise rotation of the inner shuttle guide arm 6 to act on a collar 11 formed on the inner shuttle 2 or a collar serving as a cap of the inner shuttle, if provided, thus slightly rotating the inner shuttle 2 counterclockwise (FIG. 1) to obtain a gap or clearance between the projection 2*a* and the support segment 3.

As a result point 1*a* tends to become worn out and is reduced to a point 1*a*' whenever it is contacted with a needle 12 as is best shown in FIG. 5.

A conventional horizontal rotary shuttle opener as described herein has difficulty in adjusting the stroke of the inner shuttle guide 7 to correspond to the worn out point 1*a*'.

The inner shuttle guide 7 has been conventionally designed to pull the collar 11 counterclockwise to keep the projection 2*a* away from the support segment 3 so the needle thread loop can pass between the projection 2*a* and support segment 3. The needle thread loop is then caught or taken by the point and, thereafter, enters into the shuttle-bobbin assembly. The timing of separation of the projection from the support segment is the same with both a point 1*a* and a worn out point 1*a*'.

If the point is worn out, the inner shuttle guide 7 starts swinging when the point 1*a*' is not in the proper position which is closest to the needle 12. In other words, the point 1*a*' is separated from its suitable position by a distance of point 1*a* minus point 1*a*' so that the inner shuttle guide 7 may rotate at an unsuitable time for stitch setting. In other words, if the point is worn out, the inner shuttle guide should swing at a later time to function properly. The conventional horizontal rotary shuttle opener can not accomodate such a difference in timing.

SUMMARY OF THE INVENTION

It is therefor an object of the invention to provide a horizontal rotary shuttle opener which is capable of readily having the needle thread loop passed through the shuttle.

Another object of the invention is to provide a horizontal rotary shuttle opener which is capable of securing a desired timing to allow the needle thread loop to pass through the shuttle without any interference with the loop.

A further object of the invention is to provide a horizontal rotary shuttle opener which is capable of readily and optionally adjusting the point when the inner shuttle starts moving.

Still another object of the invention is to provide a opener for a horizontal rotary shuttle which always secures an optimum timing irrespective of condition or configuration of the point of the shuttle.

These and other objects of the invention are attained by providing an opener for a horizontal rotary shuttle in which the inner shuttle guide acts on the inner shuttle, or the collar serving as a cap of the inner shuttle, to rotate the latter in a direction opposite to the direction of the shuttle and in which a swing fulcrum, or a point of swing action, of the inner shuttle guide arm may be changed or altered.

According to the opener for the horizontal rotary shuttle, when the position of the swing fulcrum of the inner shuttle guide arm is changed, the point where the inner shuttle guide bar starts rotating is also changed. Additionally, when the position of the point of swing action of the inner shuttle carrier is changed, not only is the point where the inner shuttle guide starts rotating changed resulting in a change in the phase of swing movement but the stroke swing of movement is also altered.

BRIEF DESCRIPTION OF THE DRAWINGS.

The accompanying drawings illustrate preferred embodiments of the present invention in, wherein;

FIGS. 6A and 6B are a perspective view and a sectional view showing a configuration of a pin and a lug formed on the pin, respectively.

DETAILED DESCRIPTION OF THE DRAWINGS

Figure 1:
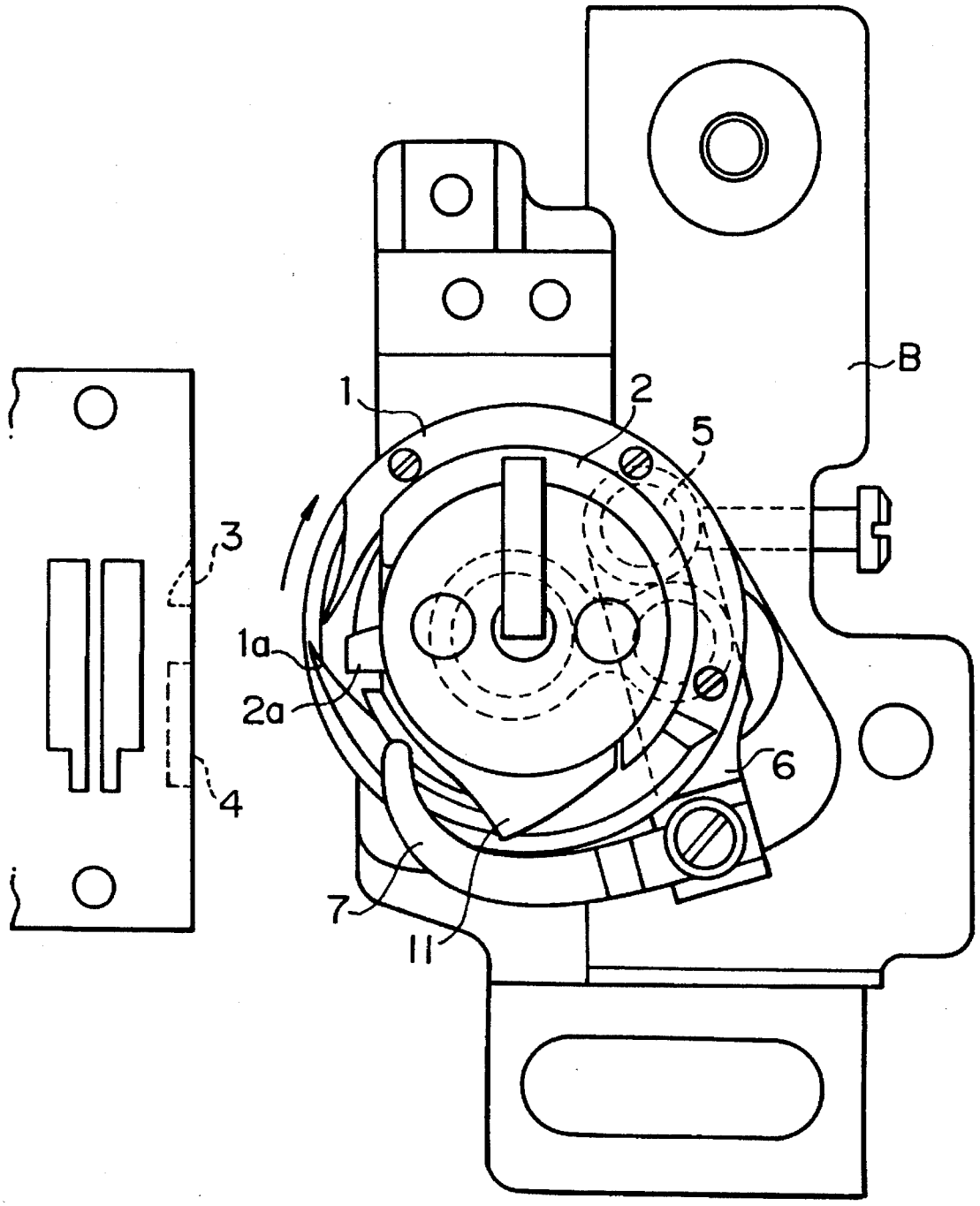
FIG. 1 (Prior Art)
FIG. 1 is a plain view of a conventional opener.
Figure 2:
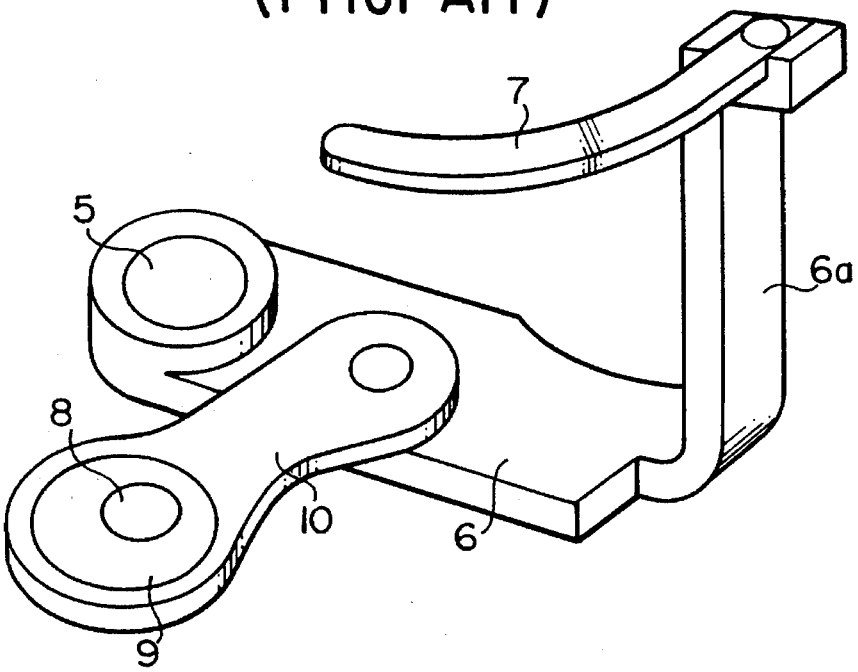
FIG. 2 (Prior Art)
FIG. 2 is a perspective view fragmentally showing the conventional opener.
Figure 3:
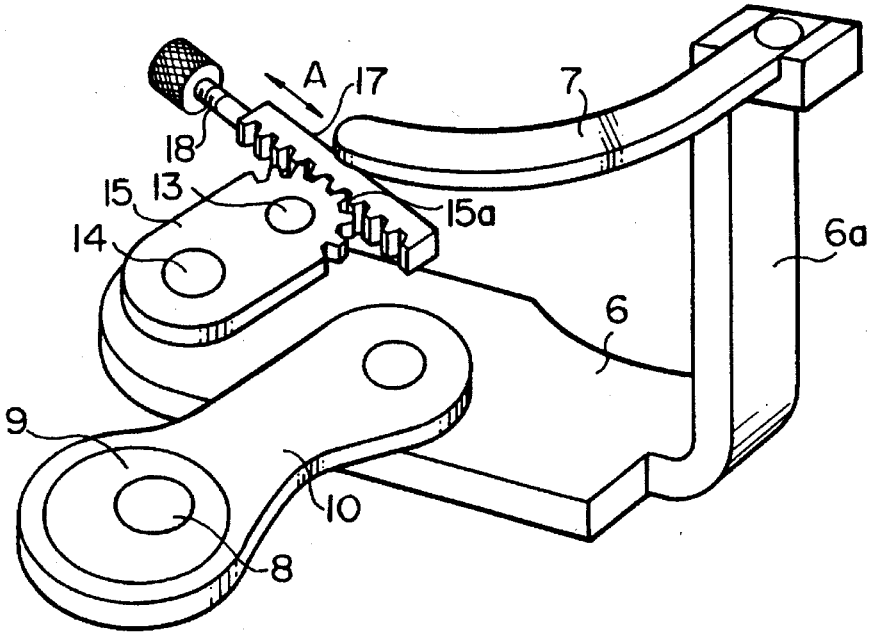
FIG. 3 is a perspective view fragmentally showing an opener according to the present invention.

Referring to FIG. 3, an opener shown as one embodiment of the invention comprises an inner shuttle guide arm 6 having a shank 6*a* at one end thereof and an adjustment mechanism such as a fulcrum change link 15 at the other end thereof and a means for repositioning and restraining an initial position of the link. The shank 6*a* carries an inner shuttle guide 7 mounted on the shank 6*a* at its top end, a swing lever 10, one end of which is provided with an eccentric cam 9 disposed about a shuttle shaft 8 and the other end of which is pivoted to the inner shuttle guide arm 6 at the center thereof, and a fulcrum change link 15, one end of which is rotatably supported on a fulcrum shaft 13 fixed to a shuttle shaft base B (FIG. 1) and the other end of which is rotatably supported by a pivot 14 on the inner shuttle guide arm 6. A serration 15*a* in a pinion form is formed on the fulcrum change link 15 at one end thereof near a fulcrum shaft 13 to swingably manipulate the fulcrum change link 15 about the fulcrum shaft 13 from the underside of the sewing machine. The serration 15*a* is disposed to mesh with a rack 17 formed on a knurled headed screw 18. The screw 18 is manipulated to move the rack 17 in the direction of an arrow A.

With this arrangement, the fulcrum change link 15 is swung about the fulcrum shaft 13 by means of the serration 15*a* from above the sewing machine to reposition the pivot 14, by lowering or tightening the screw 18 against the shuttle shaft base. As a result, a fulcrum position of the inner shuttle guide arm 6 is changed to alter a point where the inner shuttle guide 7 starts swinging. The inner shuttle guide 7 changes its effective length and configuration with the change of position where the inner shuttle guide (7) is initially located. According to this embodiment, the inner shuttle guide 7 is allowed to make a constant stroke. Thus, the phase of swing movement may be varied, while the stroke of swing movement remains substantially constant.

Figure 4:
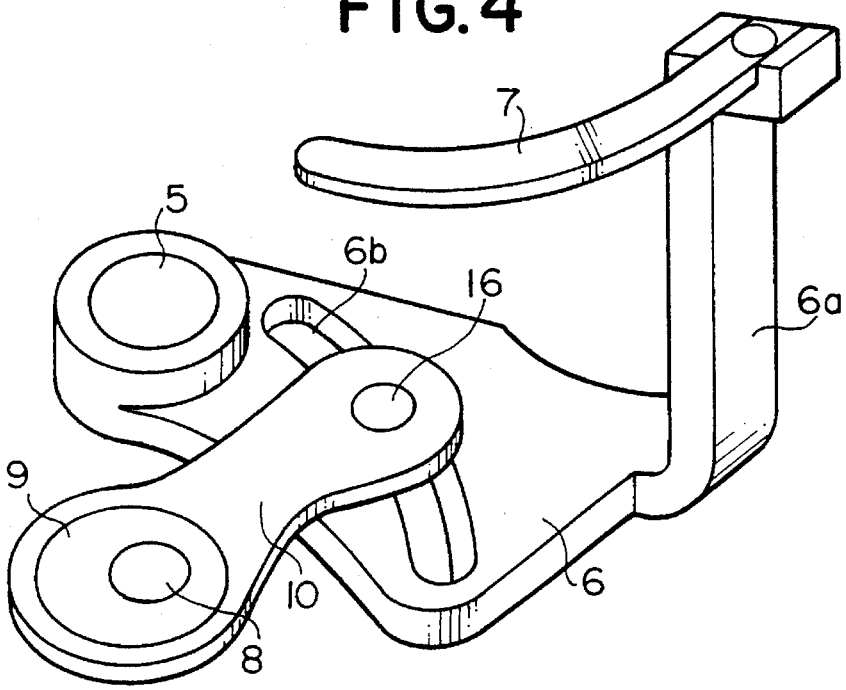
FIG. 4 is a perspective view fragmentally showing another form of the opener according to the present invention.
Figure 5:
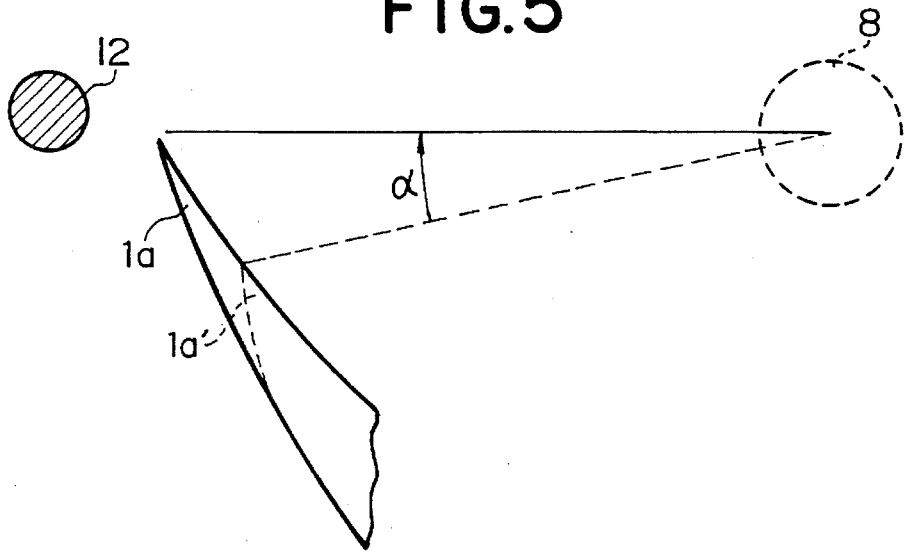
FIG. 5 is a explanatory representation of the relationship between a needle and a point of a shuttle.

Referring to FIG. 4 where another embodiment of the invention is shown, the horizontal rotary shuttle opener consists of the inner shuttle guide arm 6 rotatably supported on the fulcrum shaft 5 fixed to the shuttle shaft base B (FIG. 1) and having an adjustment mechanism such as an arcuate slit 6*b* at its center and the shank 6*a* at its free end, an inner shuttle guide 7 mounted on the shank 6*a*, the swing lever 10 having one end which holds the eccentric cam 9 secured to the shuttle shaft 8 and the other end which provides a pin 16 which engages in the slit 6*b* in the inner shuttle guide arm 6.

The slit 6*b* forms a part of an arc drawn by a radius extending from the center of the shuttle shaft 8 to the center of the pin 16. The pin 16 which engages in the slit 6*b* is provided with a lug 16*a* that is so shaped as to be along with the arc defined by the slit 6*b*, as shown in FIG. 6. The lug 16*a* of the pin 16 formed on the swing lever 10 is engaged and positioned in the slit 6*b* in such a manner that the pin 16 is moved and fastened by a screw within the slit 6*b*, and that the swing lever 10 is made swingable over the inner shuttle guide arm 6.

With the arrangement as described herein, the pin 16 is released from its anchorage to reposition it within the slit 6*b* so that a distance between the fulcrum shaft 5 and the pin 16 is varied. Thus, the path of the inner shuttle guide 7 may be retraced and phase of swing movement and stroke of swing movement vary at different points within the slit. This will assume a position where the guide 7 is finally retraced. For this reason, the guide 7 is not required to change its effective length and configuration as in the previous embodiment. In other words, in the horizontal rotary shuttle opener according to the embodiment illustrated in FIG. 4, the adjustment of the point when the inner shuttle starts moving takes place in the stroke of swing movement and phase of swing movement and, therefore, does not involve the inner shuttle guide 7 initial positioning.

Although the invention has been described by way of reference to the embodiments disclosed herein, it should be understood that the invention is not limited to the disclosed embodiments. Rather, the invention should be interpreted in accordance with the claims which follow. For example, it may be appreciated that the invention is equally applicable to embodiments wherein the slot is in the inner shuttle and the protrusion is on the machine frame.

What is claimed is:

1. In a sewing machine including a shuttle having a point for seizing a needle thread, said shuttle being rotatable by a shuttle shaft, an inner shuttle held by said shuttle, means for providing a slot and means for providing a projection formed to freely engage said projection in said slot, both means adapted to facilitate formation of a gap between said projection and said slot by enabling said projection to movably engage said slot, said sewing machine comprising:

an inner shuttle guide member comprising a guide arm supported rotatably around a first fixed axis and an inner shuttle guide secured to said guide arm and being disposed to allow one end thereof to engage said inner shuttle and axially supported to swing said inner shuttle, a lever adapted to follow said shuttle shaft and to swing said inner shuttle guide member and said inner shuttle for forming the gap between said projection and said slot when said thread seized by said point passes through the gap, and an adjustment mechanism for adjusting the phase of swing movement of said inner shuttle guide member.

2. A sewing machine as set forth in claim 1, wherein said means for providing a slot comprises a machine frame and said means for providing a projection comprises said inner shuttle.

3. A sewing machine as set forth in claim 1, wherein said adjustment mechanism is so arranged as to adjustably move a connecting point between said lever and said guide arm.

4. A sewing machine as set forth in claim 1, wherein said adjustment mechanism comprises a link having one end supported on a machine frame rotatable around a second fixed axis and the other end supported on said inner shuttle guide member and rotatable around a third fixed axis, and means for repositioning and restraining an initial position of said link.

5. A sewing machine as set forth in claim 1, wherein said adjustment mechanism further adjusts the stroke of swing movement of said inner shuttle guide member by adjusting the timing and position of engagement between said inner shuttle and said inner shuttle guide.

6. In a sewing machine including a shuttle having a point for seizing a needle thread, said shuttle being rotatable by a shuttle shaft, an inner shuttle held by said shuttle, means for providing a slot and means for providing a projection formed to freely engage said projection in said slot, both means adapted to facilitate formation of a gap between said projection and said slot by enabling said projection to movably engage said slot, said sewing machine comprising:

an inner shuttle guide member comprising a guide arm supported rotatably around a fixed axis and an inner shuttle guide secured to said guide arm and being disposed to allow one end thereof to engage said inner shuttle and axially supported to swing said inner shuttle, a lever adapted to follow said shuttle shaft and to swing said inner shuttle guide member and said inner shuttle for forming the gap between said projection and said slot when said thread seized by said point passes through the gap, and an adjustment mechanism arranged to adjustably move a connecting point between said lever and said guide arm.

7. A sewing machine as set forth in claim 6, wherein said means for providing a slot comprises a machine frame and said means for providing a projection comprises said inner shuttle.

8. A sewing machine as set forth in claim 6, wherein said adjustment mechanism adjusts the stroke of the swing movement of said inner shuttle guide member by adjusting the timing and position of engagement between said inner shuttle and said inner shuttle guide.

9. A sewing machine as set forth in claim 6, wherein said adjustment mechanism adjusts the phase of the swing movement of the inner shuttle guide member by adjusting the timing and position of engagement between said inner shuttle and said inner shuttle guide.

* * * * *